US006029553A

United States Patent [19]

Berntsson et al.

[11] Patent Number: 6,029,553

[45] **Date of Patent: *Feb. 29, 2000**

[54] METHOD AND APPARATUS FOR PRODUCING A PLURALITY OF SEQUENTIALLY ARRANGED EDGE CONTOURED SLATS

[75] Inventors: Peter Berntsson, Varekil; Peter Gawell, Jörlanda, both of Sweden

[73] Assignee: Hunter Douglas International N.V., Netherlands

[ * ] Notice: This patent issued on a continued prosecution application filed under 37 CFR 1.53(d), and is subject to the twenty year patent term provisions of 35 U.S.C. 154(a)(2).

[21] Appl. No.: 08/646,952

[22] Filed: May 8, 1996

[30] Foreign Application Priority Data

May 19, 1995 [EP] European Pat. Off. ..... 95303361

[51] Int. Cl.[7] ..... B26D 5/00

[52] U.S. Cl. ..... 83/76.1; 83/917; 83/929

[58] Field of Search ..... 83/40, 42, 46, 83/47, 48, 76.1, 76.6, 76.7, 76.9, 929, 949, 917, 333; 29/24.5

[56] References Cited

U.S. PATENT DOCUMENTS

| | | | |
|---|---|---|---|
| 4,730,372 | 3/1988 | Tsuchida | 29/24.5 |
| 4,790,226 | 12/1988 | Tsuchida | 83/208 |
| 5,022,296 | 6/1991 | Eschauzier et al. | 83/27 |
| 5,099,556 | 3/1992 | Lim | 29/24.5 |
| 5,349,730 | 9/1994 | Anderson et al. | 29/24.5 |
| 5,567,208 | 10/1996 | Larson et al. | 29/24.5 |

FOREIGN PATENT DOCUMENTS

| | | |
|---|---|---|
| 1292876 | 10/1977 | Australia . |
| 378313 | 7/1990 | European Pat. Off. . |
| 409486 | 1/1991 | European Pat. Off. . |
| 2253230 | 9/1992 | United Kingdom . |

*Primary Examiner*—Kenneth E. Peterson
*Attorney, Agent, or Firm*—Dorsey & Whitney LLP

[57] ABSTRACT

The invention relates to a method and apparatus for providing a plurality of sequentially arranged edged contoured slats for use in a blind. A strip of material 10 is provided lengthwise into the slat making machine. It passes through a forming unit 6 where it is cambered, into an accumulator 8 where any excess is held, through a position encoder 12 and over a collision detector 14. Edge contours are then cut into the strip material if they are not already pre-provided. The positions of any edge contours are detected by a sensor 18 which provides relevant information to a CPU 40. On the basis of this information and other pre-provided information on the type of blind being made guide holes and notches and the ends of the slats are cut ensuring that the contouring and the guide holes and ends do not interfere with each other.

17 Claims, 13 Drawing Sheets

S100
S101
S102
S103
S104
S105
S106
S107
S108
S109
S110
S111
S112
S113
S114
S115
S116
S117
S118
S119
S120
S121
S122
S123
S124
S125
S126
S127
S128
S129
F7
N
Y

METHOD AND APPARATUS FOR PRODUCING A PLURALITY OF SEQUENTIALLY ARRANGED EDGE CONTOURED SLATS

BACKGROUND OF THE INVENTION

The present invention concerns the production and arrangement of a plurality of edge contoured slats, for use, preferably in blinds, specifically venetian blinds.

Venetian blinds, which have a number of spaced apart horizontal slats hung together with cord, have been known for some time. Recently, the applicants for the present application have suggested making Venetian blinds using slats with edges which have been specifically contoured. The result is a new aesthetic visual effect in the finished blinds. The present invention is intended for use in the production of such slats for such blinds.

Some visual effects can be achieved by using identical slats throughout. Other effects require slats with similar edge contours but with the contouring phase—shifted from one slat to the next. Others again require slats with random edge contouring. In many cases it is not sufficient that the slats should differ from each other. They must differ in precise ways and must be stacked in a correct order.

Patent document EP-A-0 378 313 describes a method and apparatus for cutting a strip material into slats for venetian blinds. The strip material from which the slats are cut is pre-printed with a surface pattern. This document indicates how to prevent the production of a blind with adjacent slats having specific portions of surface pattern at the same distance along their lengths.

It is an aim of the present invention to provide sequences of slats with edge contours, arranged according to a required edge contour pattern.

The inventors of the present application have determined that one problem with using contoured slats is that the contours can interfere with any lift cord holes, ladder guide notches, and even the ends of the slats both visually and physically, such that the blinds may not work efficiently or may be in danger of failing.

It is a further aim of the present invention to remove, or at least partially alleviate, the problems of such interference.

SUMMARY OF THE INVENTION

According to one aspect of the present invention, there is provided a method of mechanically producing a plurality of sequentially arranged slats for use in a blind, from strip material having a lengthwise extent, an end and two longitudinal edges, said method comprising the steps of:

- providing said strip material with edge contours at positions along at least one of its longitudinal edges;
- cutting the strip material into lengths having two ends and two longitudinal edges to provide slats of predetermined length;
- determining the positions of the edge contours on the strip material if the edge contour providing step precedes the cutting step and of the ends of the slats otherwise;
- controlling the positions of one or more ends of the strip material during the cutting step relative to its position or their positions during the edge contour providing step, in accordance with predefined slat production data, to control the relative positions of the edge contours on the slats and the ends of the slats; and subsequently
- collecting said slats into a predetermined sequence.

According to a further aspect of the present invention, there is provided apparatus for producing a plurality of slats for use in a blind, from strip material having a lengthwise extent, an end and two longitudinal edges, said apparatus comprising:

- means for feeding said strip material into the apparatus;
- cutting means for cutting said strip material into lengths having two ends and two longitudinal edges to provide slats of predetermined length;
- determining means for determining the positions of the edge contours on the strip material if the edge contours are provided on the strip material prior to the strip material being cut by the cutting means or for determining the positions of the ends of the slats otherwise;
- controlling means to control the relative positions of said edge contours and the ends of the slats according to predefined slat production data; and
- collecting means for collecting said slats into a predetermined sequence according to the positions of edge-contours provided along at least one longitudinal edge of the slats.

In use the invention may proceed in any one of a number of ways. For example the strip material may be precontoured. In this case, it is cut into slats of the correct length having regard to where the contours are relative to the ends of the slats and other guide features, the desired pattern in the resultant blind and, if possible, the minimisation of wastage. Alternatively, the strip may be cut into slats of desired length and then contoured, having regard to the positions of the ends, other guide features and the desired pattern in the resultant blind.

The invention is able to overcome the problems that using prior art apparatuses and methods would introduce by ensuring, whether or not the edge contouring is provided before the slats are cut to length, that the positioning of the contours relative to the ends is controlled so as to reduce the problems of interference between the contours and the slat ends and any lift cord holes and ladder guide notches.

It is a further aim of the present invention to provide a ladder spreading mechanism which can be used with contoured slats.

According to a further aspect of the invention there is provided a ladder spreading mechanism for use in threading slats into a ladder cord, comprising:

- a pair of lift fingers separated by a gap, within which, in use, the ladder cord passes, each lift finger having an inner face opposing the other lift finger across said gap; and
- a positioning device for causing said ladder cord to be pressed against the inner face of either lift finger; wherein
  - said inner faces are convex in shape, so as to tend to move the side cords of the ladder cord apart as the ladder cord is pressed against either or said inner faces.

Additionally, or as an alternative to the convex inner faces the mechanism may have a wedge-shaped ladder spreader, preferably pivotally mounted, for removable insertion between the side cords to spread them even further apart.

BRIEF DESCRIPTION OF THE DRAWINGS

The invention will be further described by way of non-limitative example, with reference to the accompanying drawings, in which.

DETAILED DESCRIPTION

Figure 1:
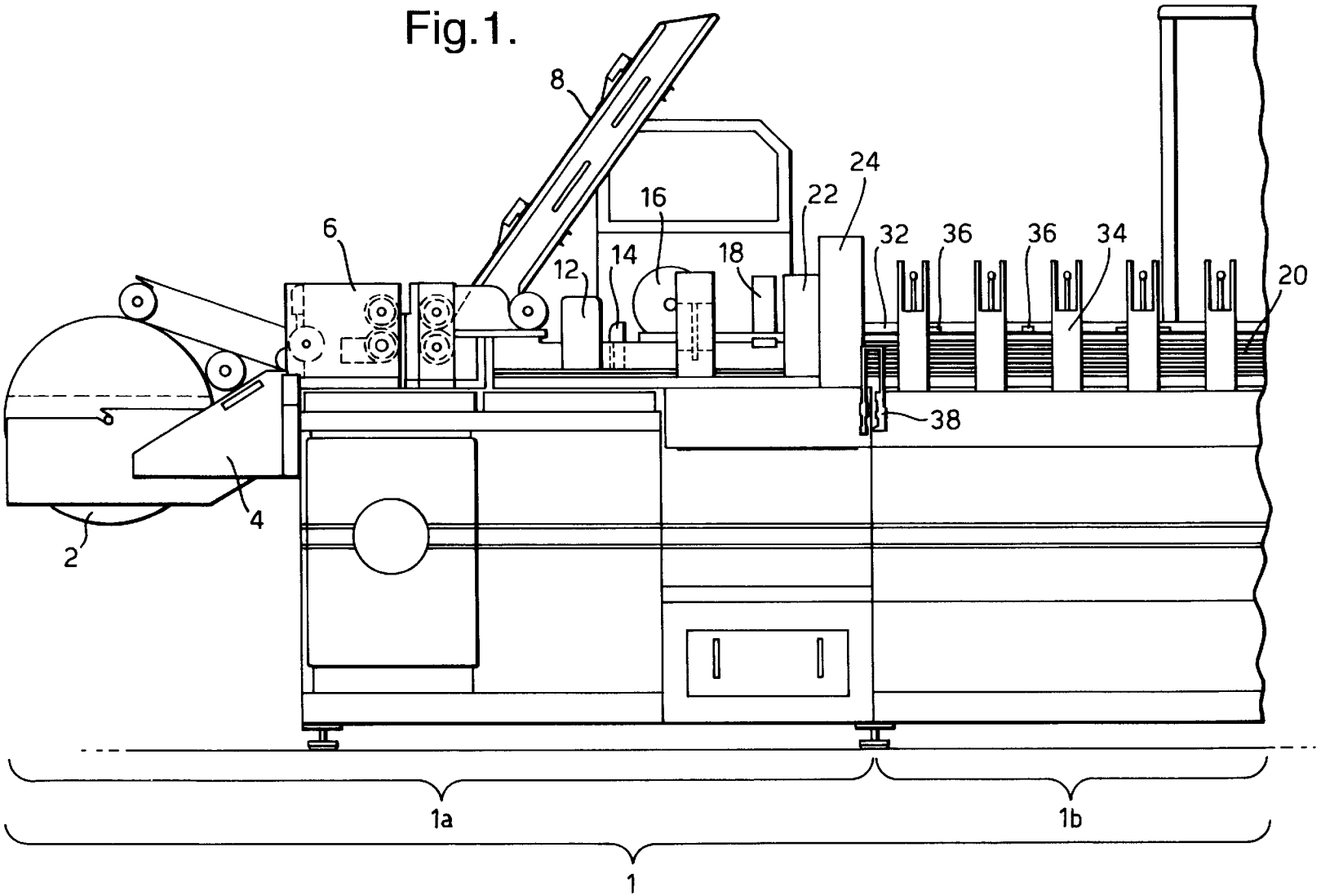
FIG. 1 is a side view of an apparatus according to one embodiment of the present invention.
Figure 2:
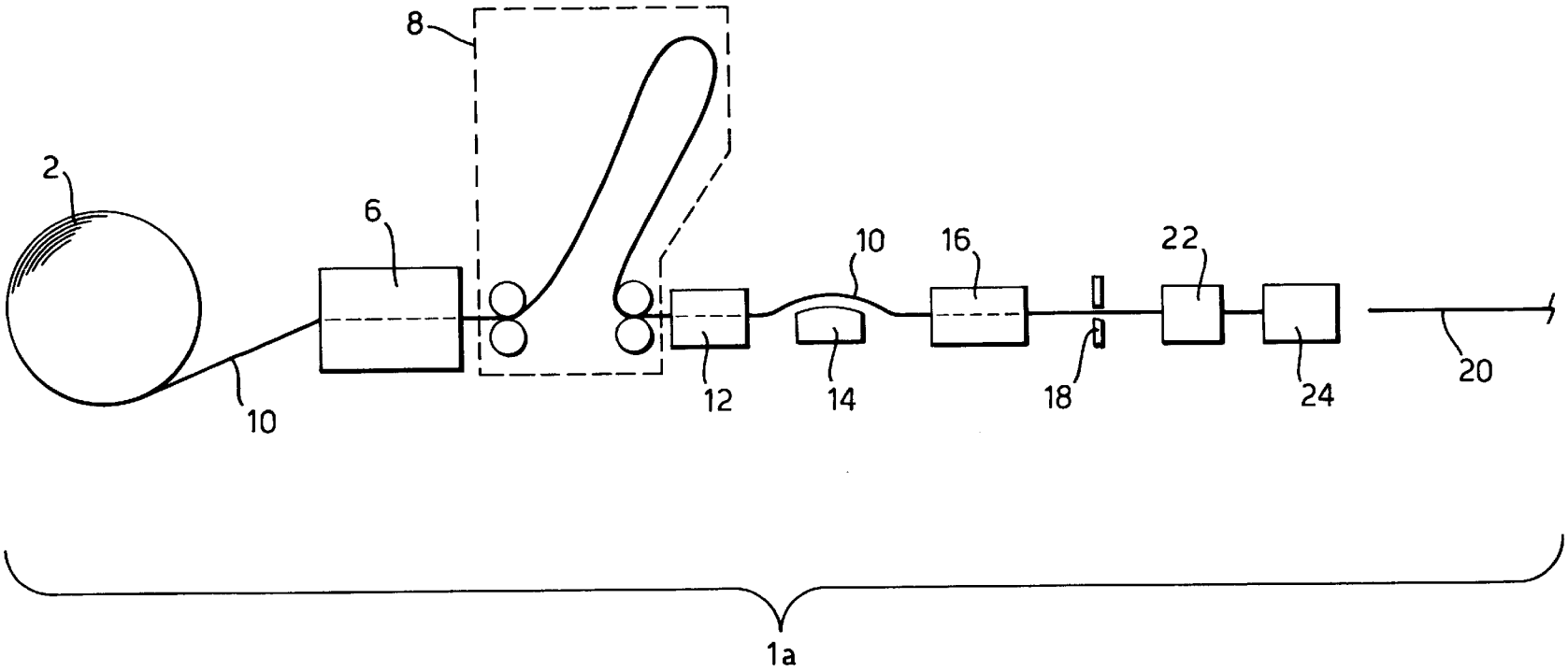
FIG. 2 is a schematic machine layout representing the apparatus in the left-hand side of FIG. 1.

FIG. 1 shows a machine, according to the present invention, for making venetian blinds of contoured slats. FIG. 2 is a stylised drawing showing particular features of the left-hand side of the apparatus of FIG. 1, that is the slat forming section 1*a*.

The strip material 10 from which the slats 20 are to be made is fed into the machine from a supply roll 2 in a pay out unit 4 (part of the "means for feeding"). The supply roll 2 may be rotated by tension in the strip material 10, or the axle of the supply roll 2 or the pay-out unit 4 may be powered.

A forming unit 6 (part of the "means for feeding ") is provided within the main body of the apparatus. This unit 6 is driven by a speed controlled motor and may be used to provide the tension, mentioned before, to pull material through the pay-out unit 4. The forming unit 6 gives the strip material 10 a cambered profile using forming wheels. An accumulator 8 (part of the "means for feeding") acting as a buffer is then provided along the path of the continuous strip material before it is cut into separate slats.

The accumulator 8 allows continuous feed from the supply roll 2 whilst further in the machine feed of the strip material stops and starts according to different cutting and/or contouring processes. The level of strip material in the accumulator 8 can also be used to control the rate of supply of strip material from the supply roll 2. Two optical sensors are provided, one in the upper part and one in the lower part of the accumulator 8. These sense the amount of strip material 10 buffered in the accumulator 8, passing the information on to a CPU (Central Processing Unit),or PLC (Programmable Logic Control) which regulates or controls the speed of the pay-out unit 4 or forming unit 6 if too much strip material 10 is being supplied to the accumulator 8.

A positioning infeed unit 12 (part of the "means for feeding") is provided downstream of the accumulator 8. A motor driven by an amplifier unit controls a rubber coated wheel to pull the strip material 10 out of the accumulator 8 and on towards the tools of the apparatus. A high precision encoder measures the movement of the strip material 10 as the position of the strip material and its rate of feed can be important later. This encoder is connected to a position unit and the CPU, which outputs signals to a servo unit for controlling the position of the strip material 10.

A collision sensor 14 is also provided along the strip material path downstream of the accumulator 8. At the collision sensor 14 the strip material 10 is bowed slightly to create a bend point in the strip material, where the strip material will bend further if its further passage is obstructed in any way. Thus, if the strip material 10 downstream of the collision detector 14 stops moving, but it is still being supplied from upstream, it will bow further at the collision sensor 14. Normally, the strip material 10 is in contact with the sensor 14, but when further bowing occurs due to excess feed from the infeed unit 12, the sensor 14 loses contact with the strip material 10. The sensor 14 then passes a "collision" signal to the CPU. Such a sensor is described in patent document GB-A-2 253 230, the contents of which document are hereby incorporated by reference.

Edge contouring and other cutting tools are provided downstream of this along the path of the strip material. In the embodiment of FIGS. 1 and 2 they are shown in one specific order, though other embodiments may have them in different orders. The same may be true for the other features already mentioned.

The first forming tool is a edge-contouring (or notching) tool 16 or ("edge contour providing means"). This punches appropriate contours 74 (see FIGS. 9*a*–9*f*) or notches in one or both edges of the strip material 10. It may be made up of a number of edging tools on either or both sides if such are required.

Downstream of the edge contouring (or notching) tool 16 there is an index sensor 18 (or "determing means"). In this embodiment, this is an optical sensor which uses optical fibre techniques to provide high precision detection of the edge pattern of the strip material 10.

The information from the index sensor 18 is passed on to the CPU which sends out signals, as a result, to punch and cutting tools as described hereafter.

A punch tool 22 (or "cut-out forming means"), downstream of the index sensor 18, is used to punch sets of lift cord holes 70 (see FIG. 8*a*) and ladder guide notches 72 (see FIG. 8) in the strip material at predetermined distances apart. The positions at which they are punched depends on information supplied from the index sensor 18 via the CPU, to ensure that these holes and notches are not positioned inappropriately.

In this embodiment a cutting tool 24 (or "cutting means") is provided downstream of the punch tool 22. The cutting tool 24 cuts the strip material 10 into slats 20 of predetermined length. The strip material 10 is positioned in the cutting tool 24 according to information from the index sensor 18, to ensure that the ends are cut at the correct distances from any edge contours and lift cord holes and ladder guide notches cut by the punch tool 22. If any lift cord holes 70 and ladder guide notches 72 have been cut, this should determine where the end cuts must be.

Once the slats 20 have been formed they leave the slat forming section 1*a* and pass into the slat collecting section 1*b*.

Figure 3A:
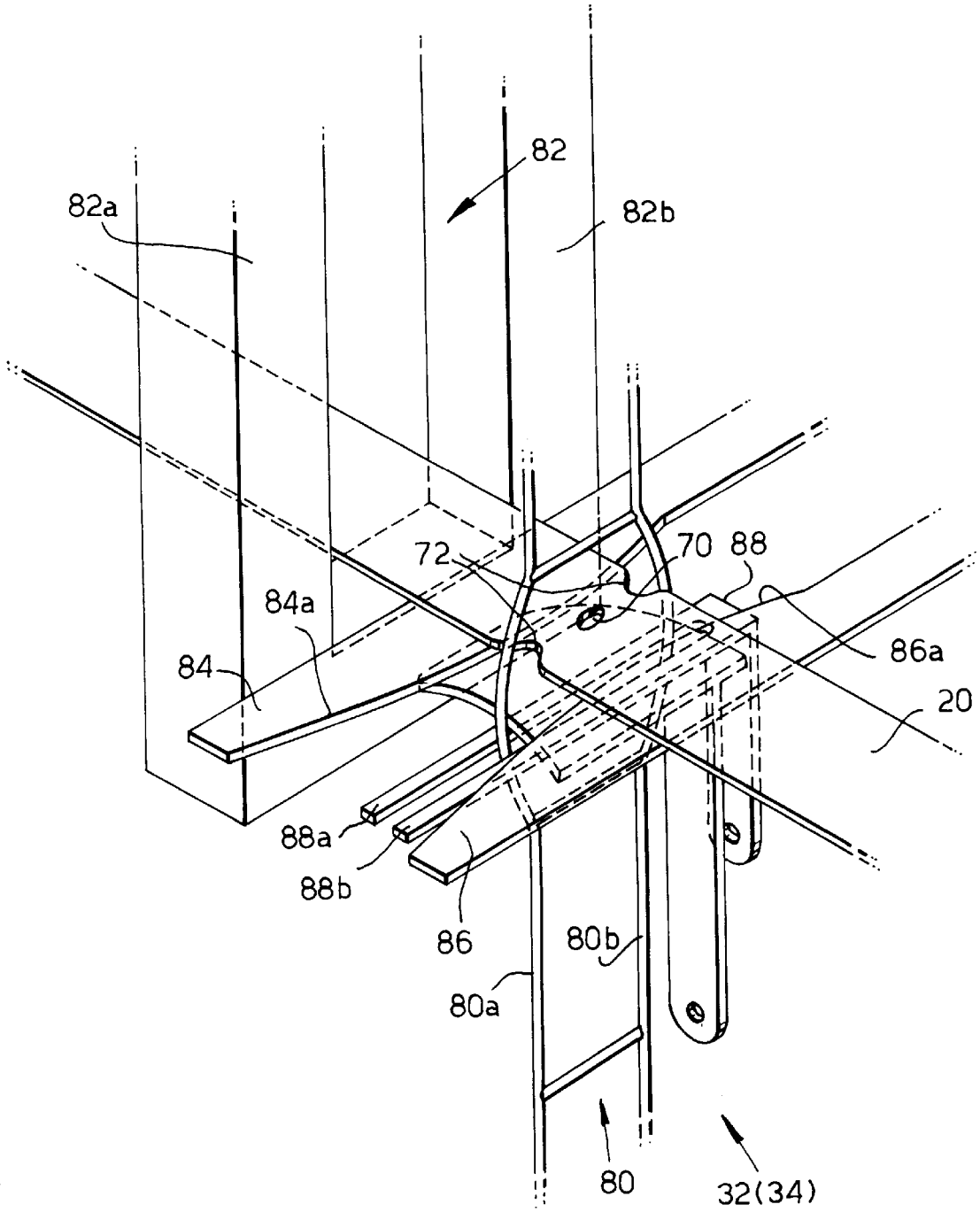
FIGS. 3*a* to 3*c* are various views of a lifting/lacing station used in an embodiment of the present invention.
Figure 3B:
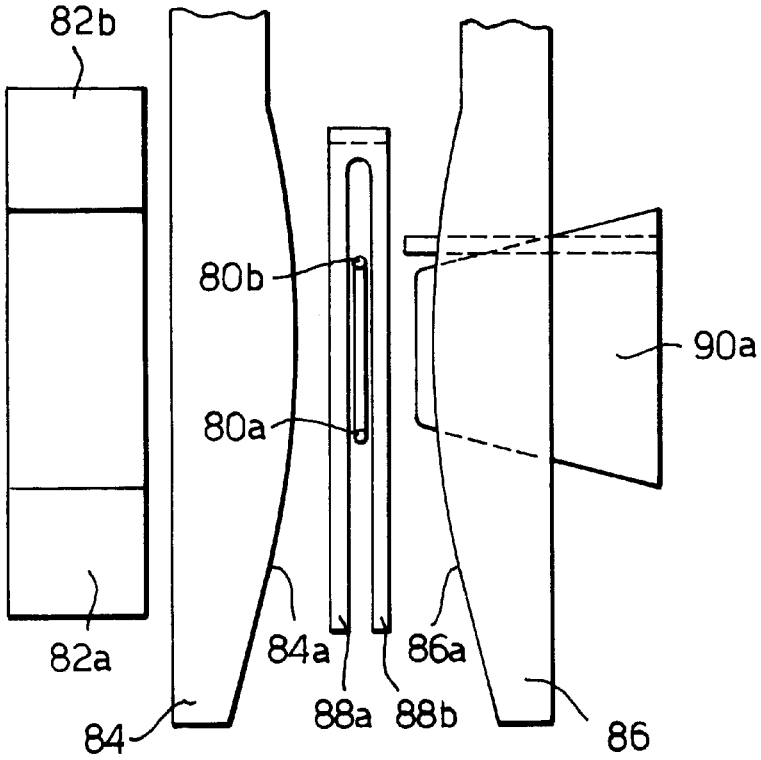
Figure 3C:
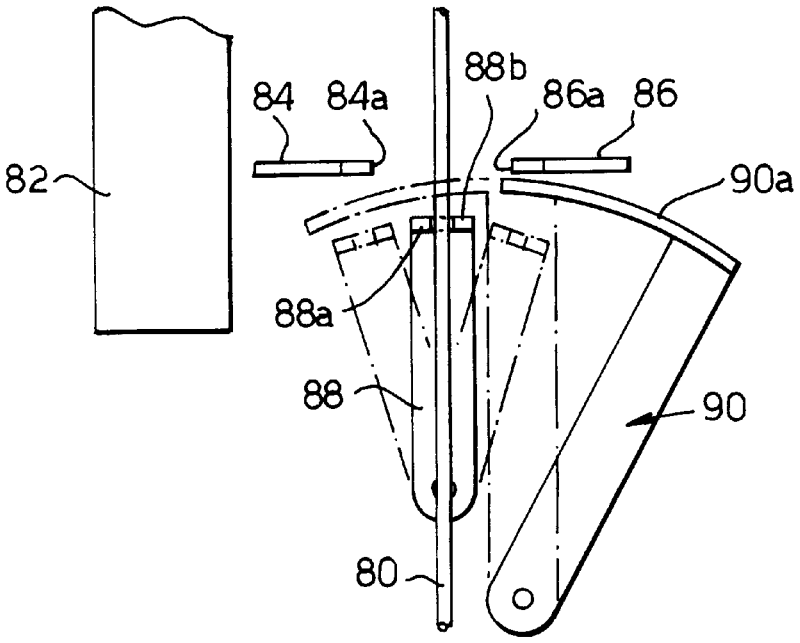
Figure 8:
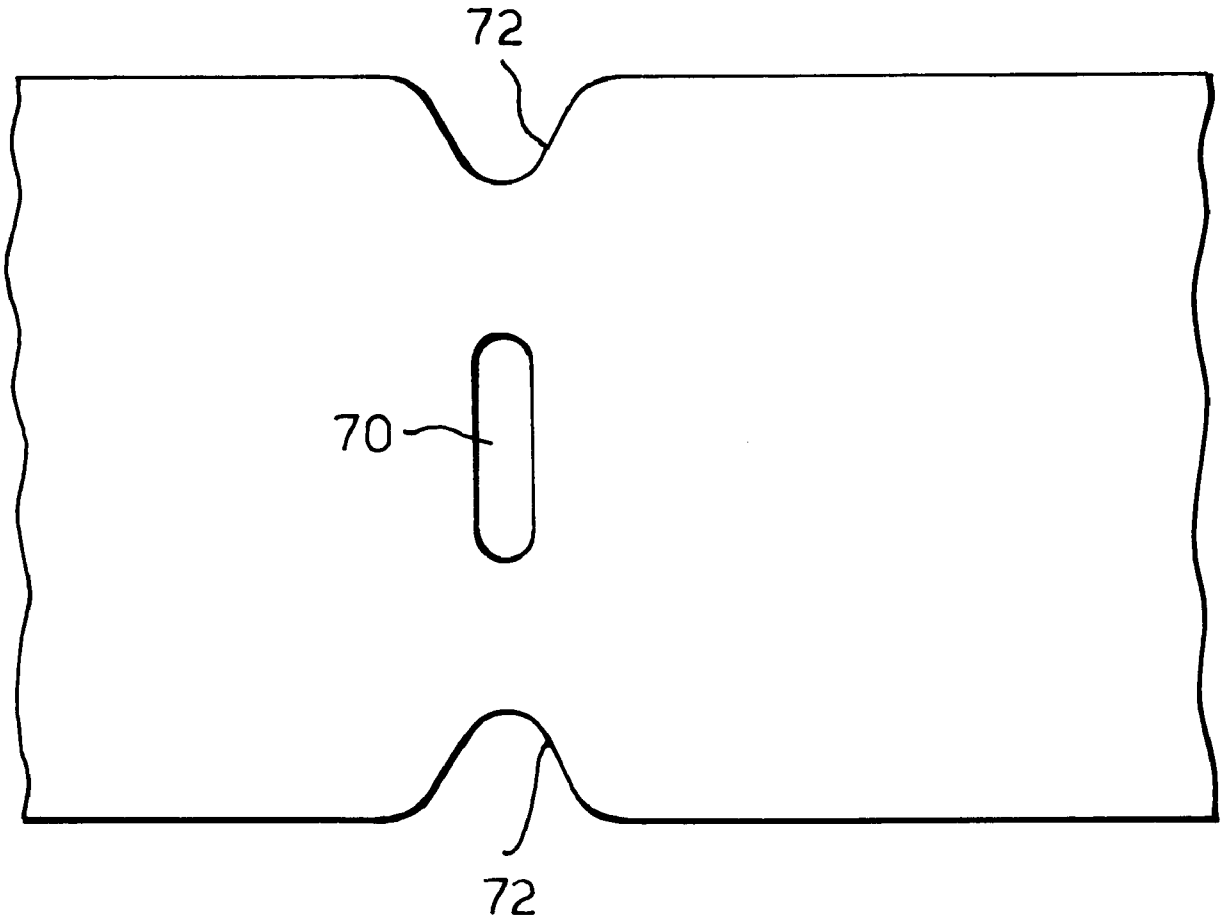
FIG. 8 shows an intermediate portion of a slat with a lift cord hole and ladder cord notches.

Part of the slat collecting section 1*b* is shown in greater detail in FIGS. 3*a*, 3*b* and 3*c*. By the time a slat 20 reaches the collecting section 1*b* it includes a lift cord hole 70 and ladder guide notches 72, as can be seen in FIG. 8, as well as any contouring provided by the contouring (notching) tool 16 or pre-provided on the strip. The positions and/or shapes of the ladder guide notches 72 are preferably chosen to blend in, as aesthetically as possible, with the edge contours 74. As the slats 20 enter the slat collecting section 1*b*, each set of lift cord holes 70 and ladder guide notches 72 is aligned with a lifting station 32,34 ("part of the collecting means").

The operation of an embodiment of a lifting station 32,34 will now be described with reference to FIGS. 3*a* to 3*c*.

As the leading edge of each slat 20 passes through one of the lifting stations 32,34, it is laced into a ladder cord 80 held open for it, as shown in FIG. 3*a*. Once a slat 20 has reached its correct position within the section, the ladder cord is allowed to close and the slat 20 is lifted into a buffer or support tower 82. Because of the fairly short distance between consecutive rungs in the ladder cord 80, each slat 20 is only lifted a short distance above its entry height before the next slat 20 arrives. The length of each rung in the ladder cord roughly corresponds to the width of the slats between opposing ladder guide notches 72.

The lifting station shown in FIGS. 3*a* to 3*c* has a pair of buffer supports 82*a*, 82*b*, between which the slats 20 pass, a pair of slat lift fingers 84,86, a ladder cord positioning device 88, a ladder spreader 90 and a supply of ladder cord 80. The slat lift fingers 84,86 are moveable vertically and are shown in FIG. 3*a* in their lowermost positions, ready to allow the current slat 20 to pass over them. In between the slat lift fingers 84,86, and slightly below them, is a narrowly separated pair of positioning fingers 88*a*, 88*b*, which form the ladder cord positioning device 88.

The two positioning fingers 88*a*,88*b* extend longitudinally in a direction perpendicular to the slats 20 entering the lifting stations 32,34. They ensure that the ladder cord 80 which passes up between them is correctly orientated and in the correct position when the end of a slat 20 passes through that lifting station for lacing the slat 20 into the ladder cord 80. The cord 80 is supported from above by the lowermost slat 20 in the buffer 82 and is advanced upwardly with each subsequently laced and lifted slat 20. Tension is maintained in the ladder cord 80 by an upstream ladder cord tensioning device (not shown) which frictionally engages the ladder cord 80, whilst allowing gradual pay-out from the supply and also whilst holding the two side cords 80*a*, 80*b* of the ladder cord 80 apart. The ladder cord positioning device 88 provides the cord 80 at a position in the path of the slats 20 as they enter the lifting station 32,34. It is mounted to pivot between two slightly spaced positions about an axis perpendicular to the length of the slats 20. This pivoting action allows rungs of the ladder cord 80 to be positioned on different sides of the lift cord hole 70 (lengthwise of the slats 20). The rungs may alternate which side of the lift cord hole 70 these are on, from one slat 20 to the next, or in other patterns as controlled by, for instance, the previously mentioned CPU 40, or another one.

Each of the slat lift fingers 84,86 is a thin plate, preferably parallel to the plane in which the slats 20 enter the lifting stations 32,34. They are spaced apart by a distance which allows the required movement of the positioning device 88 to position the ladder cord 80, relative to the lift cord hole 70, as mentioned above. Both lift fingers 84,86 have a convex inner face or edge 84*a*,86*a* facing the other one. These convex edges 84*a*,86*a* are smoothly contoured. When the ladder cord positioning device 88 pivots to either of its extreme positions, either towards the left or right in FIG. 3*a*, the ladder cord 80 is held against one of the convex edges 84*a*,86*a*. This action forces the two side cords 80*a*,80*b* of the ladder cord 80, between the first rung above the lift fingers 84,86 and the first rung below the lift fingers 84,86, apart, to provide a gap between the side cords 80*a*,80*b* larger than the length of the rungs. When the ratio of the maximum width of a slat 20 to its width between opposing ladder guide notches 72 is less than a predetermined number, the gap between the two side cords 80*a*, 80*b*, caused by the convex edges 84*a*,86*a*, should be sufficient to lace that slat 20 into the cord 80. However, when that ratio is greater than the predetermined number, then a larger separation of the side cords 80*a*,80*b* will be required.

The ladder spreader 90 is shown in operation in FIG. 3*a*. In FIGS. 3*b* and 3*c* it is shown in an unengaged position (in FIG. 3*c* it is also shown, by dotted lines, in its engaged position). The ladder spreader 90 includes a wedge-shaped plate 90*a*, which is preferably symmetrical about an axis roughly parallel to the feed direction of slate 20 and curved about an axis roughly perpendicular to the feed direction of the slats 20. It is also pivoted about the perpendicular to the feed direction or one close to it with a greater range of movement than that of the ladder cord positioning device 88. In its unengaged position, the spreader 90 has no contact with the ladder cord 80 at either extreme position of the positioning device 88. However, when the spreader 90 is activated, the spreader plate 90*a* moves leftwards in the orientation shown in the Figures. The thin end of the plate 90*a* passes between the side cords 80*a*, 80*b* at a position slightly above the positioning fingers 88*a*, 88*b*. As the wedge passes further between the side cords 80*a*, 80*b* it comes into contact with them and drives them apart. The cord 80 is prevented from moving leftwards with the motion of the spreader 90 by the left hand positioning finger 88*a*, or by the left hand lift finger 84*a* if the positioning device 88 has been rotated to the left. The spreader plate 90*a* is curved so that, as the plate 90*a* is rotated, the point on the side cords 80*a*,80*b* in contact with the plate 90*a* does not move significantly in a vertical axis. The result is that, as shown in FIG. 3*a*, the side cords 80*a*,80*b* are spread further apart than is achieved using the convex edges of the lift fingers 84*a*,86*a*. Such extra spacing clearly allows insertion of slats 20 which have at least one portion along their length of greater width than the length of the rungs of the ladder cord 80.

In FIG. 3*a*, the side cords, 80*a*,80*b* are still held apart by the spreader 90 and the slat 20 has just been laced in between them. From this state, the spreader is disengaged, moving rightwards. The spread side cords 80*a*,80*b* are released to become accomodated in the ladder guide notches 72. The slat is lifted by the slat fingers 84,86 and then supported by the slat supports 36 which already support previously laced slats in any known manner. The slat lift fingers 84,86 are then lowered. The lifting of the previous slat also lifts the ladder cord, so that that is now in a position to receive the next slat 20. The cord is then spread using the convex edges 84*a*,86*a* and/or the spreader plate 90*a*.

In the slat collecting section 1*b* there are a number of these lifting stations, according to the number of ladders required in the finished blind.

The lifting station and the method of operation described above is not limited to use with contoured slats, but can be used with other types, e.g. straight-edged or curved slats.

Slat supports 36 are provided before and after the first lifting station 32. These supports 36 are retractable to enable the repositioning of lifting stations 32, 34.

A waste diverter 38 is provided at the junction of the two sections. This is a metal plate which redirects waste parts of the strip material 10 from the cutting tool 24 into a waste basket when, because of the positions of the contours indicated by the index sensor 18, part of the strip material 10 is wasted between consecutive slats.

The apparatus described above with reference to FIGS. 1 and 2 may be used both when the strip material is pre-provided with edge contours and when contours are to be formed by the machine itself. In the former case the machine does not need the edge contouring or notching tool 16.

When slats are to be produced the above mentioned apparatus operates as follows.

Strip material is fed from the supply roll 2 through the pay-out unit 4 and into the forming unit 6. There it is cambered as may be required later in the finished blind. From the forming unit 6 the strip material passes into the accumulator 8. There any excess strip material collects as the process downstream of the accumulator stops and starts the downstream passage of the strip material whilst at the same time it is continuously supplied from the supply roll 2.

Strip material is drawn out from the accumulator 8 through the positioning infeed unit 12. This provides the CPU with information as to the speed of travel of the strip material and/or the length of material which has travelled past it. After the infeed unit, the strip material 10 passes over the collision detector 14 and into the edge contouring (or notching) tool 16. If the strip material is precontoured the edge contouring (or notching) tool 16 will not be operated unless further contouring is required. If this tool 16 is to be operated it can provide a continuous, random or predetermined series of edge contours or notches in the strip material 10. In this embodiment the notching tool 16 is succeeded by the index sensor 18.

The index sensor 18 notes the positions of the contours in the edge or edges of the strip material and feeds that information to the CPU. Alternatively, or additionally, if the strip material 10 is precontoured it may be provided with reference points along its edge for detection by the sensor 18. If the strip material is cut to a predetermined pattern the reference points may be used by the CPU to calculate position reference points for each slat.

Once the strip material 10 has been edge contoured and these contours have been detected by the sensor 18, the CPU determines where any guide holes and notches as well as the ends of the slats should be cut. The determination of the positions for such cuts is done according to certain rules. Instances of such rules are discussed later; an example might be that no ladder guide notch may be cut at a position where the contouring has already reduced the width of the slat to below a certain limit. For certain patterns, in order for the CPU to determine where any guide notches and holes and end cuts should be made, the CPU may need to know the notch pattern on the strip material for some distance. In that case the strip material 10 may be fed past the punch tool 22 and cutting tool 24 without being acted on by them, until sufficient length, possibly much longer than the length of a slat, has passed the sensor 18. At that time the strip material may be pulled back into the accumulator 8 from which it is again fed out, and this time acted on by the punch tool 22 and cutting tool 24 to provide appropriate features at appropriate positions.

The CPU may also be used to ensure that there is minimum wastage of strip material. This is clearly easier where there is a predetermined pattern cut into the edge or edges of the strip material so that the CPU is "aware" of what comes next. This is also easier if the slat collecting section allows slats to be held in storage before being stacked in their final order, so that consecutively cut slats are not necessarily adjacent to each other in the final blind.

Once the slats have left the slat forming section 1*a* they are then collected into stacks in the order required to produce a particular visual effect. As the slats are being collected they will normally be woven or laced into the ladder cords etc used to operate the finished blinds.

In the preceding embodiment the punch tool 22 precedes the cutting tool 24. However, since, for the most part, the positions of any lift cord holes and ladder guide notches determine the positions of the ends of the slats and vice versa, the cutting tool 24 may precede the punch tool 22, they may be combined into one tool or they may be separated by some other tool.

Further, in the preceding embodiment the edge contouring (and notching) tool 16 almost immediately precedes the punch tool 22. It may, however, be almost anywhere in the system prior to that point. It is, however, useful to have it positioned after the positioning infeed unit 12 and collision sensor 14 to ensure that, where necessary, the edge contours are cut at precise positions. Further, the index sensor 18 does not need to succeed the edge contouring (and notching) tool 16 immediately. In this embodiment the sensor 18 need only be downstream of the edge contouring (and notching) tool 16 and upstream of the punch tool 22 and cutting tool 24.

So far the invention has been discussed where the edge contouring is done before any lift cord holes and ladder guide notches are cut into the strip material and before the strip material is cut into appropriate lengths for slats. The present invention, however, covers the case where the contouring is done after that or between different parts of it.

When the end cutting is done before contouring the strip material may be cut into lengths, without wastage, between consecutive strips. The ends are then formed and any lift cord holes and ladder guide notches cut without need to refer to pre-existent edge contouring. The edge contouring and notching tool 16 will then be controlled by the CPU to cut notches at appropriate places taking into account the positions of the ends of the slats and of any lift cord holes and ladder guide notches. As a further variation the strip material may be cut into the appropriate lengths, edge contoured according to where any lift cord holes and ladder guide notches are going to be positioned and then provided with lift cord holes and ladder guide notches. Other variations may also be possible within the scope of the present invention.

Figure 4:
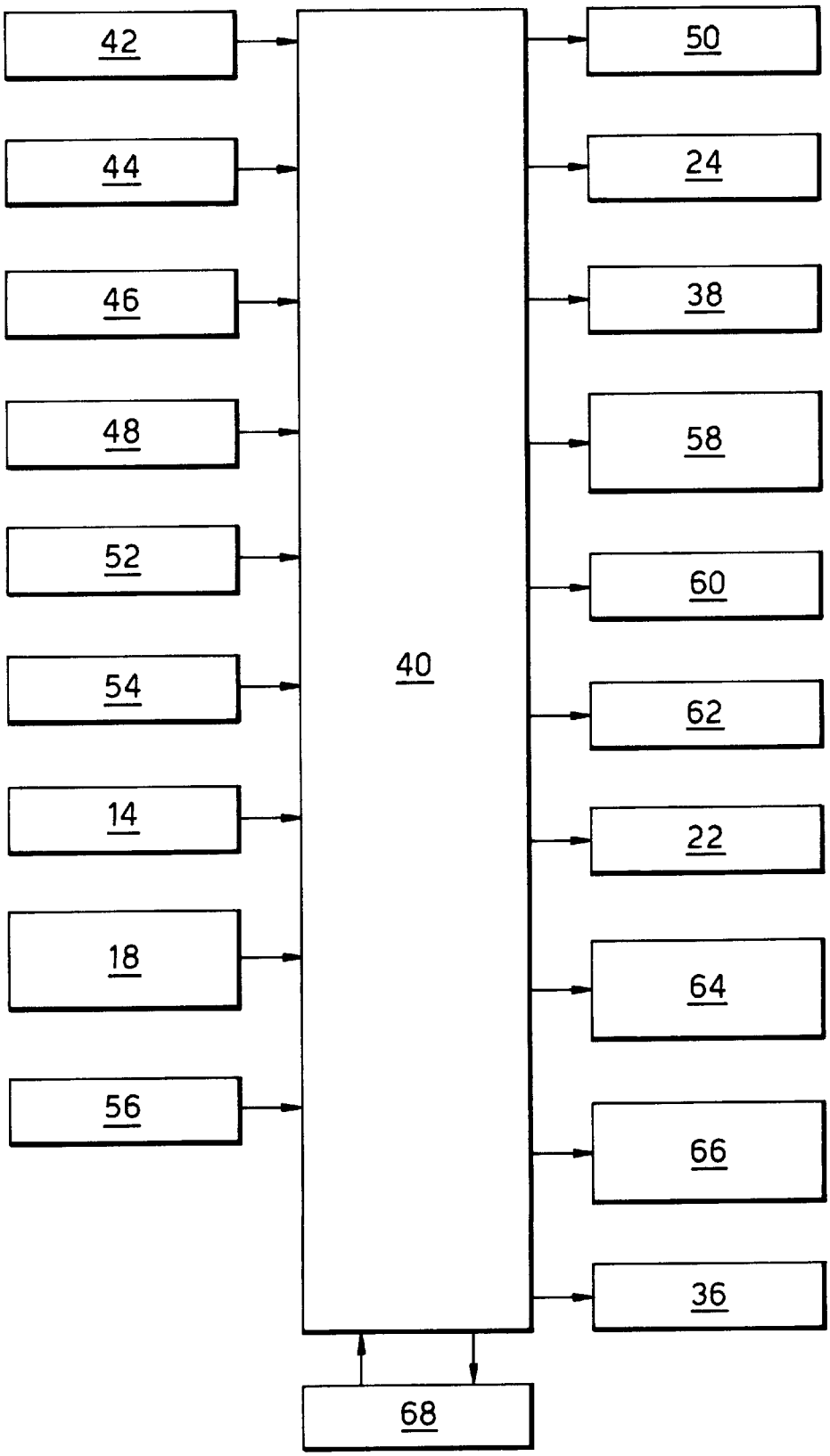
FIG. 4 is an input/output diagram for a CPU (or controlling means) for controlling the apparatus of FIG. 1.

FIG. 4 shows an input/output diagram for the CPU for such apparatus as previously described. On the left-hand side of the diagram are the various inputs received by the CPU, whilst on the right are the functions which the CPU controls.

The CPU 40 receives instructions from an operator, via the machine control panel/input keys 42. These instructions may be by way of details of some or all of the dimensions and other features of the required slats and blinds. They may include details of the required pattern or edge contouring. Alternatively, the instructions may be by way of codes specific to particular constructions of blinds. Once the CPU 40 receives such code instructions, it consults with a memory (not shown) to determine the specific instruction details and set-up for each aspect of the job.

A feed position encoder 44 (part of the "means for feeding") which is part of the positioning infeed unit 12, provides the CPU with details as to the position and movement of the strip material within the apparatus.

An activity/position counter 46 provides a count of where the apparatus is within certain sub-routines, such as the patterning, or cutting or lacing of the slats in the blind. This counter indicates to the CPU when one or more of the sub-routines has finished. A finished slat counter 48 indicates to the CPU when a slat has been finished and when the last slat in a blind has been fixed into the blind, to reset the machine to start again.

On the output side, the CPU 40 operates a feed unit servo 50 (part of the "means for feeding") which is part of the feed unit 12 as described earlier. The servo 50 is operated in forward or reverse on the basis of various of the inputs, for instance the input instructions, the feed position from the infeed unit and the activity/position counter and is used to move each slat or particular part of the strip material to the right place at the right time.

The end cutting tool 24 is operated by the CPU 40 to cut the strip material into slats at the right time. The waste diverter 38 is operated as a result of the end cutting tool 24 cutting lengths of excess material between two consecutive slats and operates to move the waste to a bin or elsewhere.

The above inputs and outputs are usually essential. FIG. 4 includes further inputs and outputs, each of which is individually optional.

If the apparatus if provided with an accumulator 8, then the accumulator may use lower and upper sensors 52,54. The lower sensor 52 senses when there is too little strip material 10 in the accumulator 8, and the upper sensor 54 senses when there is too much strip material 10 in the accumulator 8.

As mentioned before, the collision/obstruction sensor 14 is used to indicate when there is some obstruction in the apparatus, for instance in the edge contouring and notching unit 16, or possibly elsewhere downstream.

The index sensor/contour reference point detector 18 is used to determine the exact position of each contour passing through to ensure that no lift cord hole, ladder guide notch or end cut is made in the wrong place relative to the contours. The feed position encoder 44 and the index sensor provide information to the CPU which is used to ensure correct positioning of all the features.

A pattern step counter/rapport control 56 can be used to provide the CPU with information as to the number of patterning steps left and also the status of the desired rapport.

On the output side, accumulator and forming unit drive rollers 58 are controlled by the CPU 40 according to the inputs from the accumulator lower and upper sensors 52, 54. These are used to accelerate or decelerate the input of the strip material to ensure that the accumulator 8 has neither too much nor too little material.

The CPU also controls front edge contour tools 60 and back edge contour tools 62 in the edge contouring and notching unit 16. They can be a single tool or two tools operated as one or separately. The end cutting tool 24 can be modified to provide contoured end cuts in the slats as an alternative to or in addition to the straight end cuts of a normal end cutting tool 24. Such a contoured end cut may provide a smooth transition with the edge contour(s) of the slats. The hole/notch punch tool 22 is operated to provide the slats with any lift cord holes and/or ladder guide notches. It is operated by the CPU 40, as with the end cutting tool 24 and front and rear edge contour tools 60,62 according to information received from the feed position encoder 44 and the index sensor/contour detector 18.

A finished slat collector 64 (part of the "collecting means") is used to collect slats once they have been edge contoured, end contoured, hole punched and notched. The lifting/lacing stations 32,34 are simultaneously controlled by the CPU 40 to direct the slats into ladders strung in the pathway to link the slats into the blind and to lift them out of the way into a buffer position. A lift/lacing stations positioning and setup drive 66 initially positions or repositions the lifting lacing stations prior to the production of a particular blind. This is also controlled by the CPU 40. The intermediate slat supports 36 are retractably operated by the CPU 40 to support the slats during the lacing process. The adjustability of the supports allows them to be used when the lift/lacing stations are in any one of a number of positions.

Finally, a random generator 68 may be attached to CPU 40 to provide random information to the CPU when random contouring is required.

Figure 5:
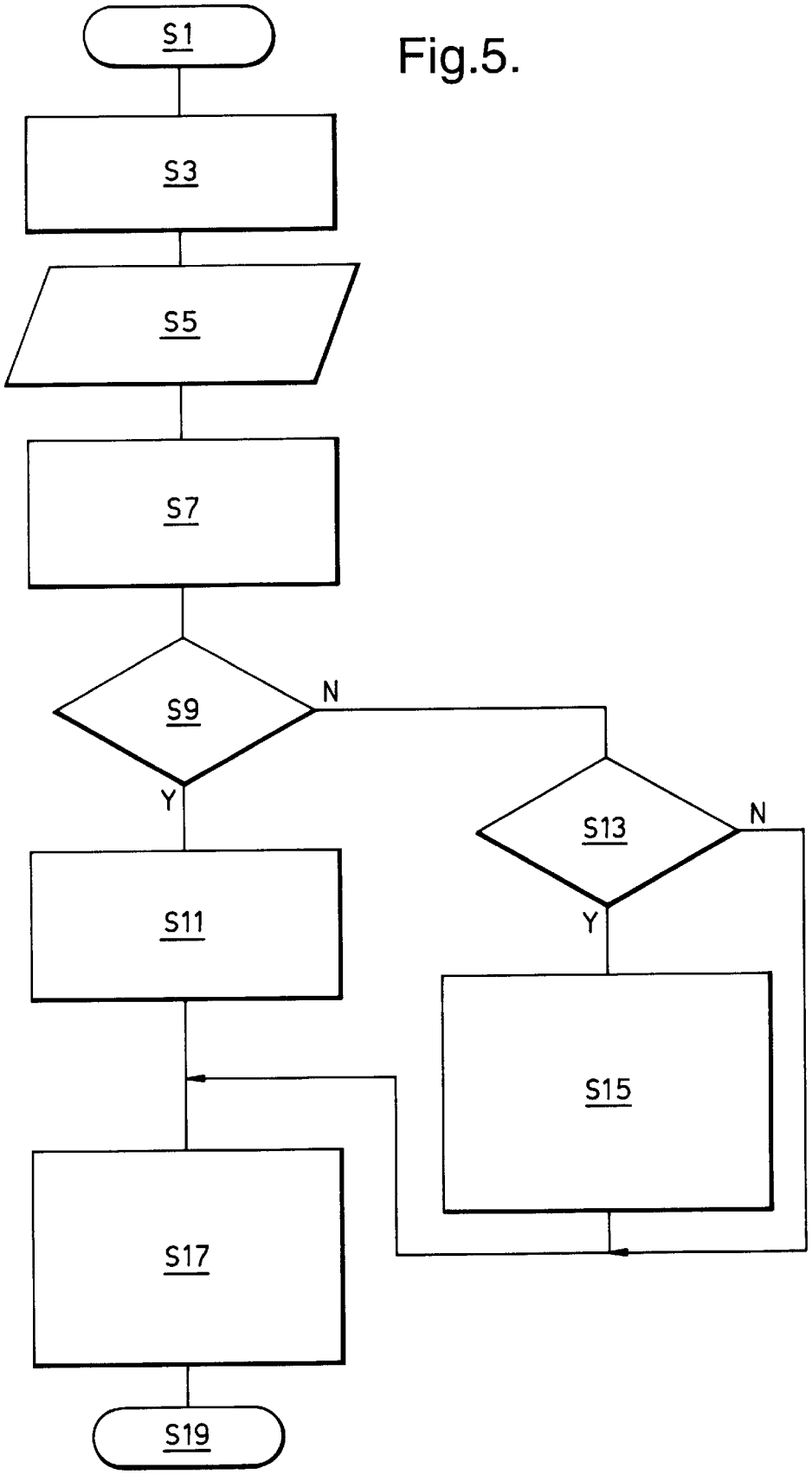
FIG. 5 is a general flowchart giving an overview of the function of a method according to one embodiment of the present invention.

A general overview of a process according to the present invention will now be described with reference to FIG. 5.

The process starts at step S1 (start). At step S1 the machine is at standby, either because it is not on or it has finished a run. Some action causes it to restart, perhaps as a result of being turned on, reset or as a result of a malfunction. Thus at step S3 (reset functions) the machine resets its various functions and flags. At step S5 (input of blind specifications) blind or slat specifications are fed in, manually by an operator, electronically from a supply machine or by some other means, for instance from a bar code or other information provided on or with the strip material being fed into the apparatus. At step S7 (calculation of slat dimensions) the CPU calculates the various slat dimensions appropriate to the blind specifications which have been provided.

At step S9 (edge contour present?), the apparatus determines whether or not edge contouring is already present. This can be determined by physical sensing or by consideration of the input information. As a result of the determination the process proceeds to step S11 (activate index sensor) if all the required edge contouring is present, or to step S13 if it is not. In step S11 the index sensor 18 is activated to detect reference points in the strip material if it has them or to detect the individual contours if it does not. In the alternative step, step S13 (edge contour desired?) when it has been determined in step S9 that insufficient or no edge contouring is present, the apparatus determines from the input information whether or not some or more edge contouring is desired. If edge contouring is desired, then the process proceeds to step S15 (contouring of front and/or back edges) in which the contouring of the front and/or rear edges of the strip material is formed. If possible this is performed with reference to actual intended positions of slat ends, lift cord holes and ladder guide notches. Otherwise it is done taking into consideration that they will be required. Step S17 (sequentially produce slats and optional waste lengths) follows Step S11, Step S15 and Step S13 if no edge contouring is desired. In step S17, the slats are sequentially produced by cutting the strip material into individual slats of particular lengths with any required lift cord holes and ladder guide notches. The cutting of the strip material into lengths may produce waste lengths of strip material. The contouring and cutting continues until the required numbers of slats have been produced, at which time the process proceeds to the end step S19 (end) (or may return to step S1 if the device is to be used again).

Figure 6:
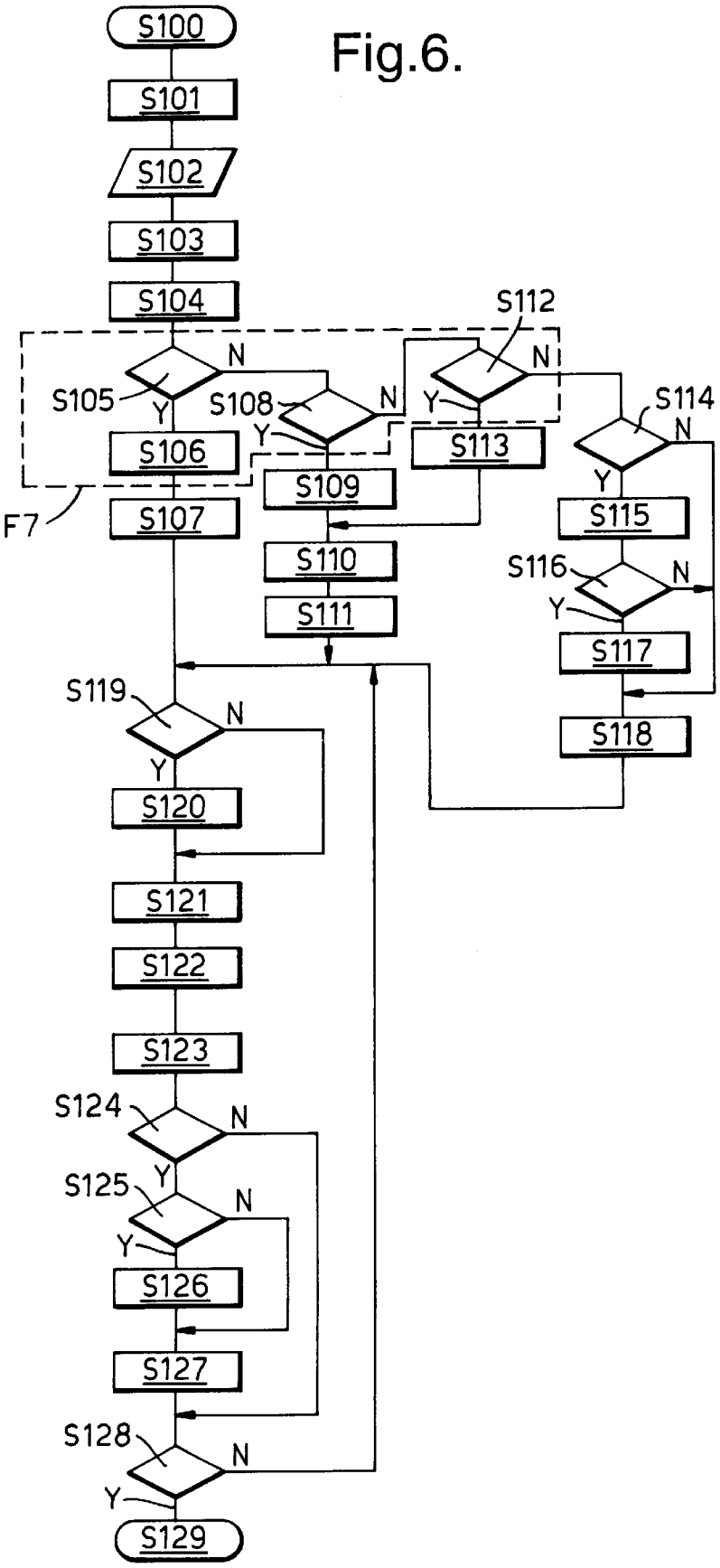
FIG. 6 is a detailed flowchart of a method according to a further embodiment of the present invention.

FIG. 6 is a flow-chart for a more detailed overview of a process according to a specific embodiment of the present invention. In a machine using this process, either the slats are required with no edge contouring at all, the strip material is pre-provided with edge contouring or the only edge contours which are required are randomly spaced notches. The process describes the production of what are termed Type 1, 2, 3, 4 and 5 slats. The different types are differentiated by the degree of randomness, similarity between slats and type of edge contouring, as will be described later.

Step S100 (start) is the start step in which the apparatus is idle. As before, the apparatus may be at this stage because it has not been turned on, it has finished its preceding task, or it may be been interrupted in a previous task. At step S101 (machine self check and reset of functions) where a new process is starting, the machine runs a self-check and resets its functions including the counters and flags. In Step S102 (input of blind parameters, dimensions, type of slat and rapport of pattern) an operator, as before, inputs supply parameters, such as the dimensions and the types of slat, and optionally a rapport of the blind pattern. This step S102 may be replaced with a step in which a specific job code is entered by an operator, or by a step in which the details of the job code are read off the material as it is entered for processing. As a result of the information input in Step S102, in the following step, step S103 (calculate number, lengths and route hole positions) the CPU calculates the number and lengths of individual slats, as well as any lift cord hole and ladder guide notch positions, according to the input parameters. In step S104 (position lift/lacing stations, activate intermediate slat supports) the lift/lacing stations 32,34 and the intermediate slat supports 36 are activated, positioned and readied for use.

In step S105 (type 1 edge contour?) the CPU determines whether or not the blind is one requiring type 1 edge contours. If type 1 edge contours are not required then the process proceeds to step S108, and if they are required it proceeds to step S106. Step S106 (random generation of edge notches) involves the random generation of front and back edge notches on the strip material. These notches are developed randomly but are prohibited from being within certain predefined and programmed maximum and minimum distances from each other, from any lift cord holes or ladder guide notches and from the ends. Thus either the positions of any lift cord holes etc must be predetermined, or the notches must be generated such that they do not prevent the later provision of the holes etc. In the succeeding step S107 (create activity list), the device creates an activity list for blind production which involves providing the tool codes and associating them with particular positions of the strip material. From step S107 the process proceeds to Step S119.

If, at step S105, it is determined that the blind is not to be constructed of type 1 edge contoured slats, the process proceeds to step S108. In step S108 (type 2 edge contour pre-provided?), it is determined whether or not type 2 edge contours are pre-provided on the material strip from which the slats are to be made. If type 2 edge contours are pre-provided then, in step S109 (calculate length offset), the device calculates the various offsets and lengths necessary to position the edge pattern in the finished blind on the basis of the desired edge pattern, repetition pitch (i.e. repetition distance) and slat length.

If it is determined in step S108 that type 2 edge contours are not pre-provided on the strip material, the process proceeds to step S112 (type 3, 4 or 5 edge contours pre-provided?) in which it is determined whether or not edge contour types 3, 4 or 5 are pre-provided on the strip material. If they are pre-provided, then in step S113 (obtain rapport parameters) the device obtains rapport parameters from the input or from a pre-defined look-up table for the particular type of pre-provided edge contour. This done, the CPU specifies length offsets and the rapport step counter values which will be required.

From step S109 or step S113 the process proceeds to step S110 (create activity list). Here, the CPU creates an activity list for blind production comprising determining tool codes, and the relative positions of the cuts and holes necessary. Preferably it minimises the wastage between cut slats and optionally the CPU also determines the number of rapport steps. In the next step, step S111 (activate index sensor) the device activates the index sensor to detect any contour reference point, or the contours themselves to ensure that the cuts and holes etc are made in the correct positions. From step S111, the process proceeds to step S119.

If no edge contours are pre-provided according to step S112, then the process proceeds to step S114. In step S114 (repetitive surface decoration?), the CPU determines whether or not there is a repetitive surface decoration on the strip material. As with many of the other determination steps this can be either by physical detection or a determination from the input information. If there is a repetitive surface decoration, then in step S115 (check pitch vs length) the device checks the surface pattern pitch against slat length for compatibility. Incompatibility may be due to certain sections of pattern being next to each other in adjacent slats in the finished blinds. If the surface pattern is found to be incompatible in step S116 (surface pattern compatible?), then in step S117 (generate waste length) the CPU randomly generates waste lengths between 6 and 110 mm between cut slats. From there, the process proceeds to step S118. The process also proceeds to step S118 directly from step S114 if there is no repetitive surface decoration, and from step S116, if the surface pattern is not incompatible with the slat length.

In step S118 (create activity list), the device creates an activity list for blind production from the input data, comprising determining the tool codes and relating the positions of the cuts to be made to the position of the strip material. Optionally it also involves determining additional waste lengths. From step S118, the process proceeds to step S119.

At step S119 (waste length specified?), the device determines whether or not a waste length has been specified in the activity list created by the CPU in step S107, S110, or S118. If it has been specified, then in step S120 (operate waste diverter, feed servo, end cutting tool) the CPU activates the waste diverter 38, operates the feed servo 50 to advance the excess length of the strip and operates the end cutting tool 24. Once any waste length has been cut off and removed, the waste diverter 38 is retracted. Step S120 is missed out if no waste length is specified in the activity list as determined at step S119. Next, in step S121 (refer to activity list) the device refers to the activity list for the activity sequence for the next slat and reads the relevant tool codes and corresponding required slat positions. Afterwards, in step S122 (operate feed servos and tool cycles), the CPU sequentially operates the feed servos 50 and appropriate tool cycles in accordance with the activity sequence up to and including the operation of the end cutting tool. The lift/lacing stations are then activated and the slat counter updated in step S123 (activate lift/lacing stations, slat counter).

In the next step, step S124 (rapport step counter value specified?) the CPU determines whether or not the rapport step counter has a preset value specified on it. If a value is specified then in step S125 (rapport step count=preset value?), the CPU determines whether or not the value in the rapport step counter equals the preset value. If it does equal the preset value, then in step S126 (reset rapport step counter), the rapport counter is reset and then in step S127 (count rapport step) the count is increased by 1. If the rapport step count does not equal the preset value in step S125, then the device proceeds directly to step S127.

From step S127, or step S124 if no rapport count is specified, the device proceeds to step S128 (slat count=slat total?) to determine if the slat counter value equals the slat total, i.e. if the last slat has been produced. If in step S128 the value of the step counter is the same as the slat total, then the process ends at step S129 (end). If the value of the slat counter is not equal to the slat total then the process returns to step S119.

Figure 7:
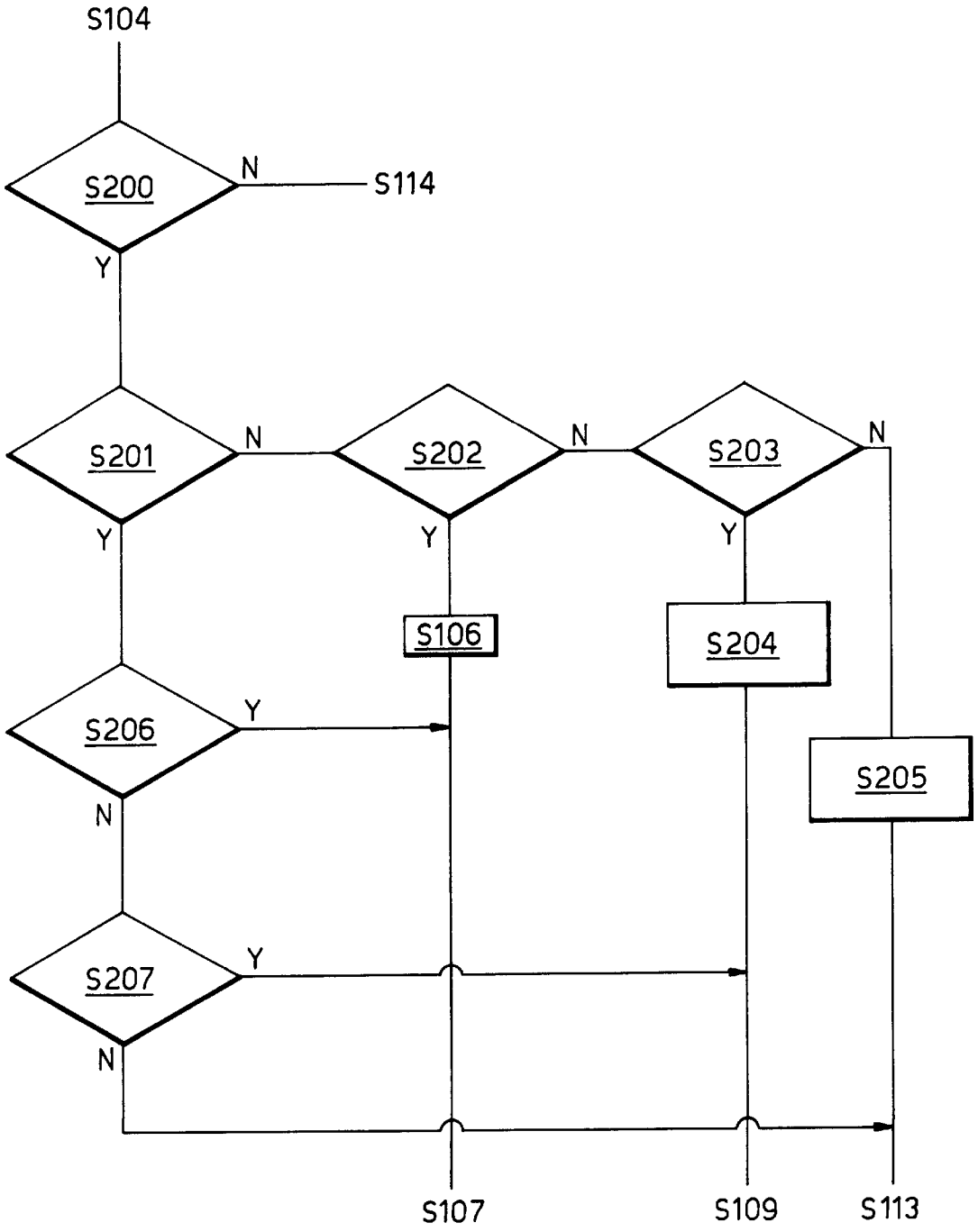
FIG. 7 shows alternative steps to some shown in FIG. 6 to provide a further embodiment of the present invention.

FIG. 7 shows alternative steps which, when combined with certain of the steps of the control process described in connection with in FIG. 6 provides a further embodiment. The steps in FIG. 7 replace the steps within area F7 of FIG. 6. In this process the CPU determines whether or not any form of contouring is required in the produced blind and whether or not any contouring is pre-provided. It starts after step S104, replacing steps S105, S108 and S112.

The first new step is step S200 which follows on from step S104. In step S200 (contoured blind?), it is determined whether or not the blind is to have edge contours. If no edge contours are required or any that there are of no importance to the subsequent production of the blind then the process goes to step S114 and proceeds in accordance with the previous process of FIG. 6. If edge contours are to be taken into account, then the process proceeds to step S201 (contouring pre-provided?) in which it is determined if the important contouring is pre-provided. If the contours are not pre-provided then in step S202 (type 1 contouring?) it is determined whether or not the required contouring is to be type 1 contouring. If type 1 contouring is required the process proceeds to step S106 (random generation of edge notches) in accordance with the preceding embodiment and from there on to step S107 (create activity list) and onwards as before.

If, at step S202, it is determined that type 1 contouring is not required, then in step S203 (type 2 contouring?) it is determined whether or not type 2 contouring is required. If type 2 contouring is required, the process goes to step S204 (perform type 2 contouring) where type 2 contouring is performed, for instance using edge cutters. From step S204, the process proceeds to step S109 (calculate length offset) and from there in accordance the preceding embodiment.

If, at step S203, it is determined that type 2 contouring is not required, then in step S205 (perform required contouring) the type of contouring which is required is formed to the strip material. From step S205, the process proceeds to step S113 (obtain rapport parameters) as with the preceding embodiment and goes on from there as before.

If, at step S201, it is determined that contouring is pre-provided the process goes on to step S206. At step S206 (type 1 contouring pre-provided?) it is determined whether or not type 1 contouring is pre-provided. If type 1 contouring is pre-provided the process goes to step S107 and continues as per the preceding embodiment.

If, at step S206, it is determined that type 1 contouring is not pre-provided, the process proceeds to step S207 (type 2 contouring pre-provided?), where it is determined whether or not type 2 contouring is pre-provided. If, at step S207, it is determined that type 2 contouring is pre-provided then the process goes on to step S109 and proceeds as per the preceding embodiment. If, at step S207, it is determined that type 2 contouring is not pre-provided, the process goes on to step S113 and continues as per the preceding embodiment.

In another alternative embodiment the question of the type of contouring required is determined before it is determined whether or not the contouring is pre-provided.

FIG. 8 shows an example of the lift cord hole 70 and ladder cord notches 72 provided for operation of the finished blind.

Figure 9A:
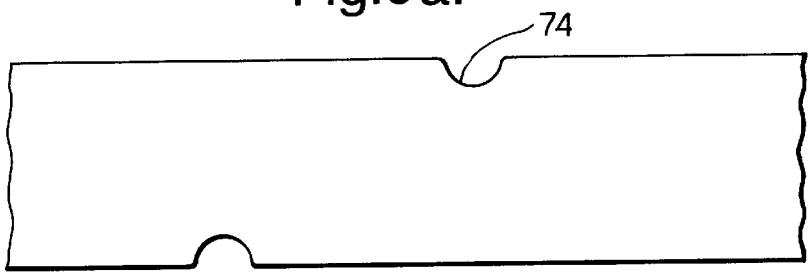
FIGS. 9*a* to 9*f* show different edge contours and arrangements which may be produced according to the present invention.
Figure 9B:
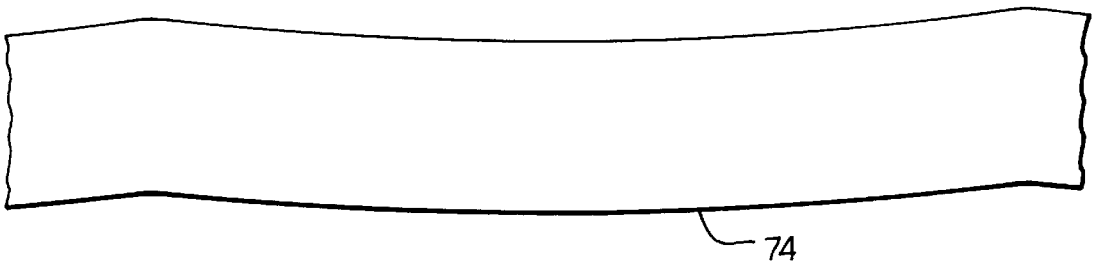
Figure 9C:
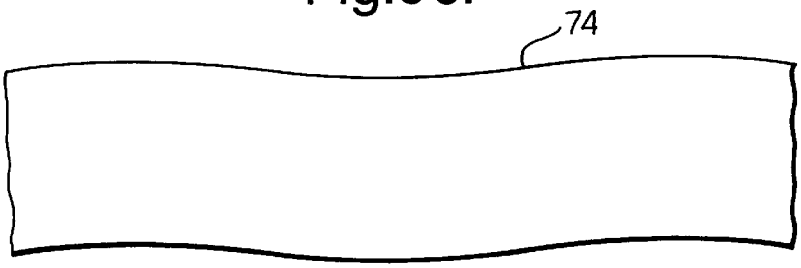
Figure 9D:
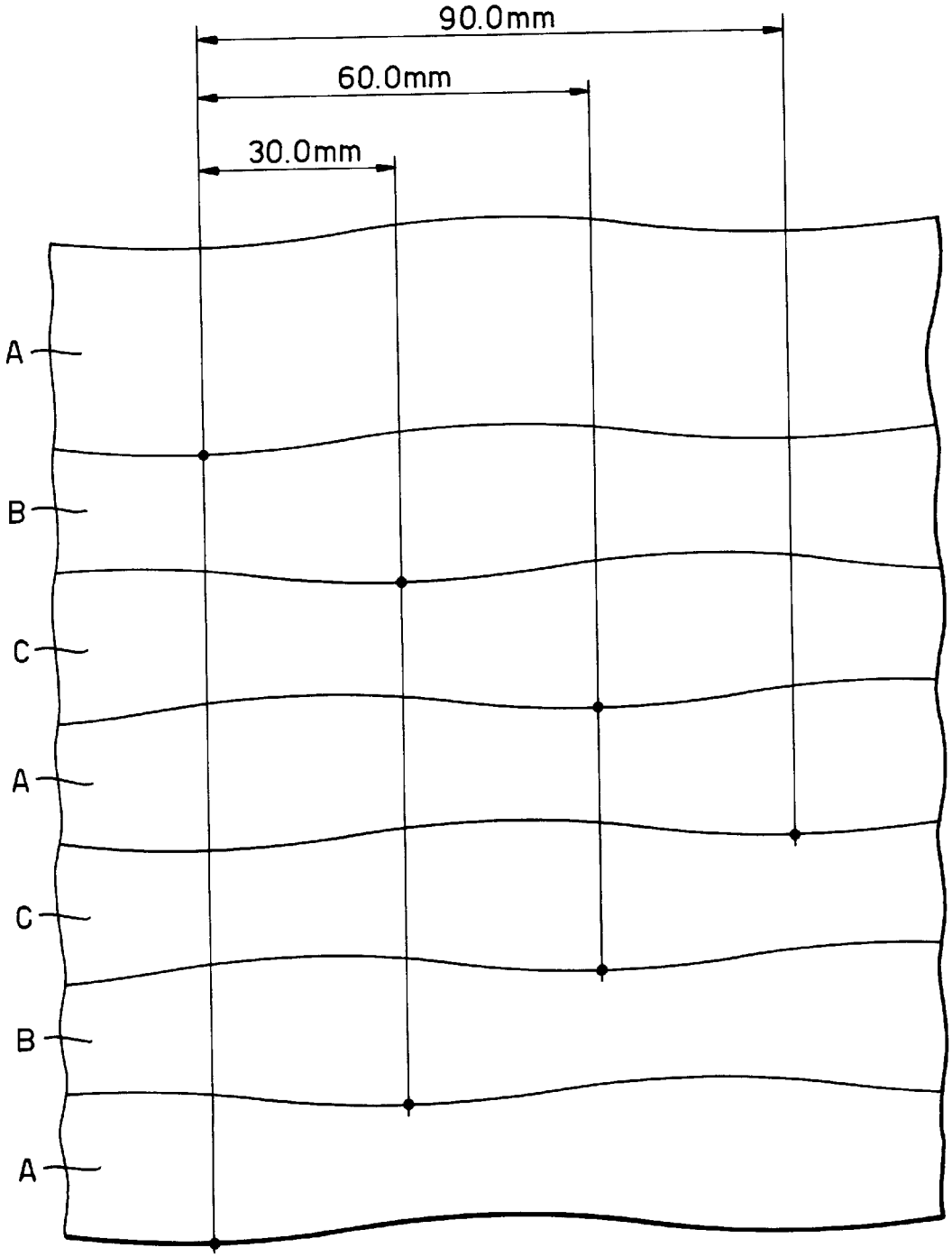

FIGS. 9*a* to 9*f* show examples of contouring which may be formed in slats and in the case of FIG. 9*d*, shows how the slats may be overlaid.

FIG. 9*a* shows type 1 contouring. In this, a hole or notch is punched randomly on both sides of the slat. Of course, the notches need not be random and further need not be on both sides. Generally the notches should be arranged so as not to interfere with cord openings, ladder guide slots or end cuts in the slats.

FIG. 9*b* shows type 2 contouring. Each side of the slat is contoured with a continuous wave configuration such that the width across the slat is constant along its entire length. A typical pattern for a sequence of such slats is to provide them so that the waveform is positioned in the same phase along the length of the blind for each slat. In that case, the slats are all identical. If that is the case then the apexes of the waves can be used as guides for the ladder strings. Generally the patterns formed by the individual slat edges should be arranged to be symmetrical with respect to the horizontal centre of the blind surface.

FIG. 9*c* shows type 3 contouring. This is similar to type 2 contouring in that waves are cut into the edge of the slats so that the slat is of constant width along its length. However, in this case, the waveform is sinusoidal and without discontinuities. Type 3 slats may be positioned in a similar fashion to type 2 or as shown in FIG. 9*d*. Here, the slats are staggered so they are out of phase, with each slat being 120° out of phase with those adjacent to it. Three different types of slat are shown in FIG. 9*d*, types A, B and C. They differ in that the peaks in type B are 30 mm to the right of the peaks in type A, and the peaks in type C are 30 mm to the right of the peaks in type B. This particular pattern involves consecutive slats in the repeated series A,B,C,A, C,B. Other series are clearly possible.

Figure 9E:
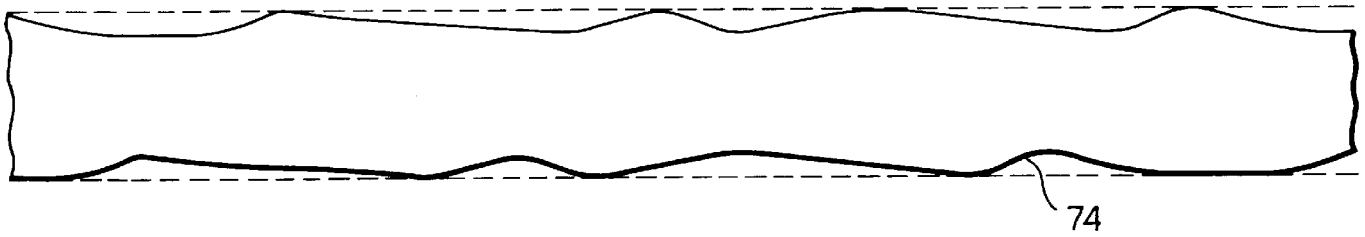

FIG. 9*e* shows type 4 contouring where the shape of the portions which are cut out from one edge are the same shape (offset slightly to the left) as the waveform left in the other edge. In FIG. 9*e* the slat is not of constant width, since the cuts in one edge are out of phase with those in the other. Again, the slats may be stacked in a blind so that each contour is at the same place for each slat or the contours may be staggered according to a predetermined rapport or at random.

Figure 9F:
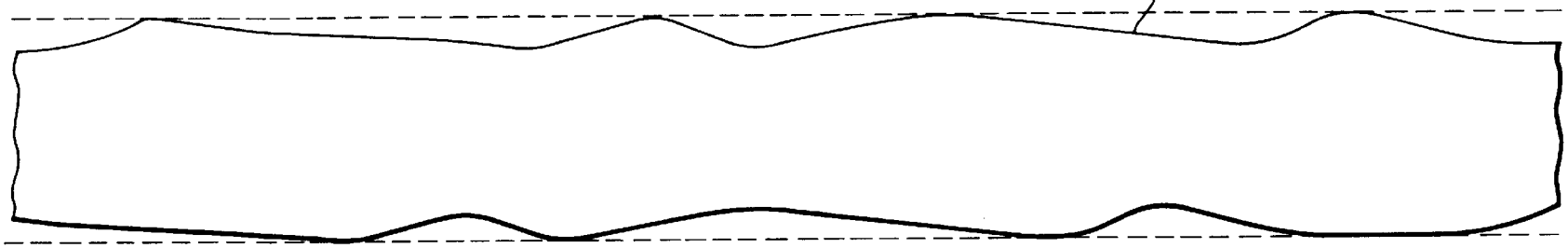

FIG. 9*f* shows a type 5 contoured slat which is similar to type 4 but is proportionally of a greater width.

It will be readily understood that any pattern cut into any edge may be random, that one edge may be contoured whilst the other is not or that one edge may be contoured with one pattern whilst the other with another pattern such that the effect is different on the two sides.

Production of some of the slat types and their arrangement using a similar process to that shown in FIG. 6 is described below more fully.

PRODUCTION FLOW FOR TYPE 1 CONTOURS (FIG. 9*a*)

(Straight edges with 5 mm deep edges cut randomly)

1.1 Production is initiated by an operator pressing AUTO on a production menu.

1.2 Accumulator 8 is filled until upper sensor 54 is activated.

1.3 CPU 40 seeds the random generator 68, checks the selected order and calculates production parameters. This results in a "activity list", each item in which includes one operation (tool) code and a position for it.

The positions for the notches are generated randomly but with following criteria:

Minimum distance between two notches, any side,= 70mm.

Minimum distance between a notch and any end of the slat=50mm.

Minimum distance between a notch and any cord hole or ladder guide notch=15 mm.

Maximum distance between two notches is a function of the slatwidth:

NOTCHmax=[(SLATLENGTH-50)/4]+100 (mm)

The list is then sorted in increasing position order.

1.4 Supports 36 are inserted, positioning counter 46 is zeroed and infeed servo 12,50 is enabled if previously disabled.

1.5 The position for the first activity is ordered to the positioning system. This activity may be an edge contouring notch (tool 16) at the left or right hand edge of the strip, or punching a cord hole or ladder guide notch (tool 22), depending on the individual positions as described at Step 1.3.

1.6 When the ordered position is reached, the actual activity/tool cycle is triggered.

1.7 The position for the next activity in the list is fetched and steps 1.5 and 1.6 are repeated until no more activities remain on the list.

1.8 The last activity is always the end cut (tool 24). When the time for the cut stroke downwards is ended, the lift station cycle is triggered. Upon completion the slat counter is decreased by 1.

1.9 If RANDOM is not specified in the order, the sequence continues at step 1.12.

If RANDOM is specified in the order a random waste length from 0 to 110 mm is calculated. Lengths below 6.0 mm are truncated to 0 mm.

1.10 The waste diverter 38 is activated and a random length is fed by the positioning system.

1.11 When the strip is newly positioned the cut cycle is triggered.

After completion, the waste diverter is retracted.

1.12 If the slat counter is not at 0, a new activity list is generated to create new random notch positions, and the sequence is repeated from step 1.5.

PRODUCTION FLOW FOR TYPE 2 CONTOURS (FIG. 9*b*)

(Shaped with "peaks", modulus 150 mm theatre curtain shape)

2.1 Production is initiated by an operator pressing AUTO on a production menu.

2.2 Accumulator 8 is filled until upper sensor 54 is activated.

2.3 CPU 40 seeds the random generator 68, checks the selected order and calculates production parameters.

This results in a "activity list" each item in which includes one operation (tool) code and a position for it.

The list is sorted in increasing position order.

2.4 Supports 36 are inserted, positioning counter is zeroed and infeed servo is enabled if previously disabled.

2.5 Centring offset is calculated. This is the offset that centres the pattern on the slat, so that the centre of a "down bow" is placed exactly in the middle of the slat. The offset is calculated as follows:

2.5-1. x=SLATLENGTH/2

2.5-2. x=x−MODULUS 2.5-3. repeat 2.5-2. until x<MODULUS 2.5-4. x=C>INDEX−x 2.5-5. if x<0 add one MODULUS (x=x+MODULUS)

2.5-6. RELREF=x.

where:

SLATLENGTH is the length of the slat (i.e. width of blind)

MODULUS is the edge pattern modulus of the slat i.e. repetition length (=150 mm)

RELREF is the resulting offset.

C>INDEX is a programmable machine parameter, the distance from the end cutting tool 24 to index sensor 18.

2.6 RELREF is set as relative reference for index search sequence.

2.7 Waste diverter 38 is activated and index search sequence is started:

2.7-1. Infeed speed is ramped up to a reference speed. (programmable machine parameter; C>REFSP)

2.7-2. During next 200 ms any signal from index sensor 18 is ignored.

2.7-3. At first detected front edge of pattern at sensor 18, (transition from inactive, not broken beam to active, broken beam) position counter is zeroed and speed is ramped down to zero.

2.7-4. positioning to RELREF is ordered and started.

2.8 At the completion of a index/RELREF sequence the cutting cycle is started and position is re-zeroed; slat is centred. After completion the waste diverter 38 is retracted.

2.9 The position for first cord hole and/or ladder guide notches is ordered to the positioning system.

2.10 When the ordered position is reached, the punch tool 22 cycle is triggered.

2.11 The position for next punch in the list is fetched and steps 2.9 and 2.10 are repeated until no more activities remain on the list.

2.12 The last activity is always the end cut (tool 24). When the time for the cut stroke downwards is ended, the lift station cycle is triggered. Upon completion the slat counter is decreased by 1.

2.13 If RANDOM is not specified in the order, the sequence continues at step 2.16.

If RANDOM is specified in the order a random waste length from 0 to 110 mm is calculated. Lengths below 6.0 mm are truncated to 0 mm.

2.14 The waste diverter 38 is activated and a random length is fed by the positioning system.

2.15 When the strip is newly positioned the cut cycle is triggered.

After completion, the waste diverter is retracted.

2.16 If the slat counter is not at 0 the sequence is repeated from step 2.5.

PRODUCTION FLOW FOR TYPE 3 CONTOURS—(FIGS. 9*c*, 9*d*)

Basic sinusoidal waves, modulus 90 mm 3.1 Production is initiated by an operator pressing AUTO on a production menu.

3.2 Accumulator 8 is filled until upper sensor 54 is activated.

3.3 CPU 40 seeds the random generator 68, checks the selected order and calculates production parameters. This results in a "activity list" each item in which includes one operation (tool) code and a position for it.

The list is sorted in increasing position order.

3.4 Supports 36 are inserted, positioning counter is zeroed and infeed servo is enabled if previously disabled.

3.5 Modulus step offset is calculated. This step arranges the pattern as shown in FIG. 9*d*

3.5-1. x=MODSTP * CZIG 3.5-2. RELREF=x where:

MODSTP is the pattern modulus step of the slat (=30 mm)

RELREF is the resulting offset

CZIG is the pattern step counter.

3.6 RELREF is set as relative reference for index search sequence.

3.7 Waste diverter 38 is activated and index search sequence is started:

3.7-1. Infeed speed is ramped up to a reference speed. (programmable machine parameter; C>REFSP)

3.7-2. During next 200 ms any signal from index sensor 18 is ignored.

3.7-3. At first detected front edge of pattern at sensor 18, (transition from inactive, not broken beam to active, broken beam) position counter is zeroed and speed is ramped down to zero.

3.7-4. positioning to RELREF is ordered and started.

3.8 At completed index/REIREF sequence cutting cycle is started and position counter is re-zeroed. Slat reference point is made. After completion, the waste diverter 38 is retracted.

3.9 The position for first cord hole and/or ladder guide notches is ordered to the positioning system.

3.10 When the ordered position is reached, the punch tool 22 cycle is triggered.

3.11 The position for next punch in the list is fetched and steps 3.9 and 3.10 are repeated until no more activities remain on the list.

3.12 The last activity is always the end cut (tool 24). When the time for the cut stroke downwards is ended, the lift station cycle is triggered. Upon completion the slat counter is decreased by 1.

Also CZIG is counted with following pattern:

0-1-2-3-2-1-0- . . . One cycle completed after 6 counts/steps.

3.13 If RANDOM is not specified in the order, the sequence continues at step 3.16.

If RANDOM is specified in the order a random waste length from 0 to 110 mm is calculated. Lengths below 6.0 mm are truncated to 0 mm.

3.14 The waste diverter 38 is activated and a random length is fed by the positioning system.

3.15 When the strip is newly positioned the cut cycle is triggered.

After completion, the waste diverter is retracted.

3.16 If the slat counter is not at 0 the sequence is repeated from step 3.5.

The contouring die 16 intermittently forms a discrete repetitive modular contour element on the strip edge with preferably a slight lengthwise overlap. This results in a continuous appearing edge contour along the length of the strip.

Figure 10A:
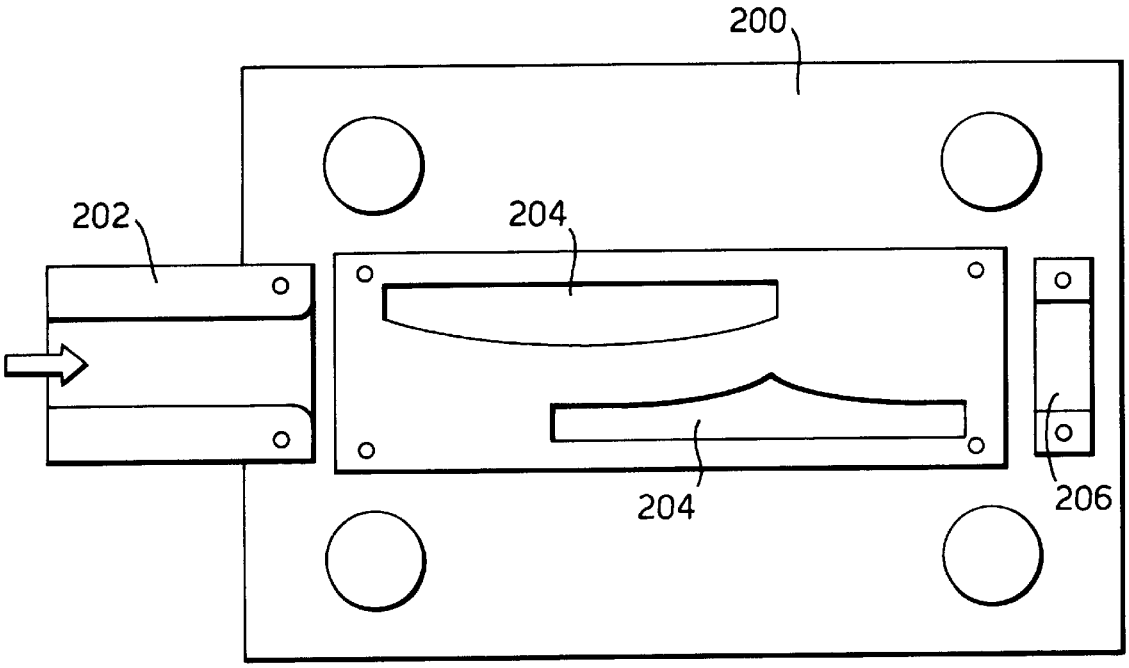
FIGS. 10*a*, 10*b* show a contouring die for use in apparatus according to the present invention, for instance such as in FIGS. 1 or 2.
Figure 10B:
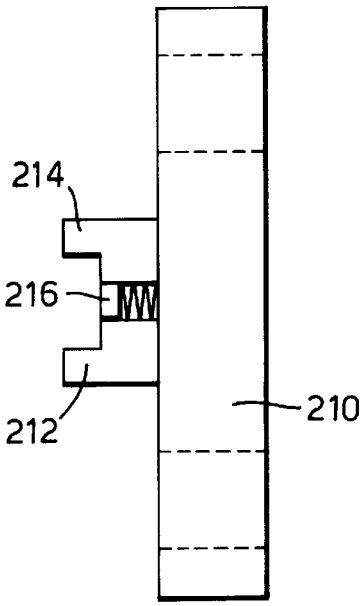

FIGS. 10*a* and 10*b* show views of a contouring die 16 for use according to the present invention. This particular die could be used to provide type 2 contours.

FIG. 10*a* shows the lower contouring die 200. Strip material 10 is fed onto the die from the left-hand side of the Figure through the infeed guide 202. From this the strip material passes over the two cutout portions 204 of the lower die 200. The leading edge of the strip material passes out to the right of FIG. 10*a* through the outfeed guide 206.

FIG. 10*b* is an end elevation of the upper contouring die 210. This has a front edge contour punch 212 and a rear edge contour punch 214. These punch downwardly through strip material 10 and into the cutouts 204 of the lower die 200. Between the punches 212,214 a spring-biased nylon block 216 is positioned to ensure that the strip material is pressed against the lower die 200 properly.

Conceivably a continuous contour along the strip edge could also be obtained by using rotating wheels provided with suitably contoured cutting edges.

As may readily be appreciated, the procedures described in this application need not be limited to the order in which they are described. For instance, contouring may come before hole punching which may come before end cutting, or end cutting may come before contouring which may come before punching, or indeed the punching may come before the end cutting which may come before the contouring. Other combinations of the three parts which may include any operation being simultaneous with the others, including all of them being simultaneous, are possible.

Whilst current production of blinds tends to use strip material of the width of the slats, which is cut according to the desired length, the present invention is also applicable to slats provided from rolls or sheets whose width is the length of the slats.

What is claimed is:

1. Apparatus for producing a plurality of slats for use in a blind, from strip material having a lengthwise extent, an end and two longitudinal edges having edge contours provided along at least one of the longitudinal edges, said apparatus comprising:

means for feeding said strip material;

cutting means for cutting said strip material into lengths having two ends and two longitudinal edges to provide slats of predetermined length, wherein said two ends are positioned relative to said edge contours;

determining means for determining positions of said edge contours on said strip material;

controlling means for automatically controlling said relative positions of said edge contours and said ends of said slats according to predefined slat production data; and collecting means for collecting said slats into a predetermined sequence according to said positions of said edge contours.

2. Apparatus according to claim 1, further comprising cut-out forming means to provide lift cord holes and ladder guide notches in said slats.

3. Apparatus according to claim 2, wherein said controlling means is operatively associated with said determining means to control relative positions of said slat edge contours and said lift cord holes and said ladder guide notches.

4. Apparatus according to claim 2, wherein said controlling means is operatively associated with said determining means to control the relative positions of the slat edge contours and the lift cord holes.

5. Apparatus according to claim 2, wherein said controlling means is operatively associated with said determining means to control the relative positions of the slat edge contours and the ladder guide notches.

6. Apparatus according to claim 1, further comprising cut-out forming means to provide lift cord holes in said slats.

7. Apparatus according to claim 1, further comprising cut-out forming means to provide ladder guide notches in said slats.

8. Apparatus for producing a plurality of slats for use in a blind, from strip material having a lengthwise extent, an end, and two longitudinal edges, said apparatus comprising:

means for feeding said strip material;

cutting means for cutting said strip material into lengths having two ends and two longitudinal edges to provide slats of predetermined length;

determining means for determining positions of said ends of said slats;

edge contour providing means for providing edge contours along at least one of said longitudinal edges of said slats, wherein said edge contours are positioned relative to said two ends;

controlling means for automatically controlling said relative positions of said edge contours and said ends of said slats according to predefined slat production data; and collecting means for collecting said slats into a predetermined sequence according to said positions of said edge contours.

9. Apparatus according to claim 8, wherein said cutting means is positioned in said apparatus downstream of said edge contour providing means to cut said strip material after said edge contours are provided on said strip material.

10. Apparatus according to claim 9, wherein said controlling means is operatively associated with said cutting means to cause said cutting means to cut varying lengths of said strip material between slats which are cut consecutively.

11. Apparatus according to claim 10, wherein said controlling means is operatively associated with said determining means to control said cutting means to vary said lengths of strip material between slats which are cut consecutively, to reduce wastage during production of the blind, on the basis of said relative positions of said slat edge contours on slats arranged in a required sequence, in accordance with said predefined slat production data.

12. Apparatus according to claim 8, further comprising cut-out forming means to provide lift cord holes and ladder guide notches in said slats.

13. Apparatus according to claim 12, wherein said controlling means is operatively associated with said determining means to control relative positions of said slat edge contours and said lift cord holes and said ladder guide notches.

14. Apparatus according to claim 8, further comprising cut-out forming means to provide lift cord holes in said slats.

15. Apparatus according to claim 14, wherein said controlling means is operatively associated with said determining means to control the relative positions of said slat edge contours and said lift cord holes.

16. Apparatus according to claim 8, further comprising cut-out forming means to provide ladder guide notches in said slats.

17. Apparatus according to claim 16, wherein said controlling means is operatively associated with said determining means to control the relative positions of said slat edge contours and said ladder guide notches.

* * * * *